US007757919B2

(12) United States Patent
Hassett

(10) Patent No.: US 7,757,919 B2
(45) Date of Patent: Jul. 20, 2010

(54) CARRYING CASE WITH SCREEN-PROTECTING SNAP

(75) Inventor: Eric S. Hassett, Golden, CO (US)

(73) Assignee: Thule Organization Solutions, Inc., Longmont, CO (US)

( * ) Notice: Subject to any disclaimer, the term of this patent is extended or adjusted under 35 U.S.C. 154(b) by 1351 days.

(21) Appl. No.: 11/221,604

(22) Filed: Sep. 7, 2005

(65) Prior Publication Data

US 2007/0051645 A1 Mar. 8, 2007

(51) Int. Cl.
*A45C 1/04* (2006.01)
*A45F 3/14* (2006.01)

(52) U.S. Cl. ..... 224/675; 224/674; 224/250

(58) Field of Classification Search ..... 224/675, 224/674, 673, 271, 272, 250, 652, 653
See application file for complete search history.

(56) References Cited

U.S. PATENT DOCUMENTS 4,545,079 A * 10/1985 Bakken ..... 2/48
5,127,545 A * 7/1992 French ..... 221/102
6,273,872 B1 * 8/2001 Friedman ..... 604/174
6,691,906 B2 * 2/2004 Cragg ..... 224/238
6,729,518 B2 * 5/2004 Badillo et al. ..... 224/578
6,823,566 B2 * 11/2004 Coffey ..... 24/579.09
6,837,409 B2 * 1/2005 Lemanski, II ..... 224/579

OTHER PUBLICATIONS

Case Logic 1999 Catalog, p. 9.
Case Logic 2003 Catalog, p. 6.

* cited by examiner

*Primary Examiner*—Nathan J Newhouse
*Assistant Examiner*—Lester L Vanterpool
(74) *Attorney, Agent, or Firm*—Sheridan Ross P.C.

(57) ABSTRACT

A carrying case is provided that includes a mechanism for generally preventing the transmission of external loads therein. The carrying case includes a tab that is adapted to interconnect with a secondary carrying case, a user's belt, etc. The carrying case also includes a resilient panel that allows a snap thereon to be isolated such that loads emanating from use of the snap are not transmitted into the carrying case.

15 Claims, 4 Drawing Sheets

CARRYING CASE WITH SCREEN-PROTECTING SNAP

FIELD OF THE INVENTION

The present invention relates generally to carrying cases for electronic devices. One embodiment of the present invention includes a carrying tab and a resilient member that deflects to allow insertion of an individual's finger. In operation, pressure forces generated by interconnecting the carrying tab to the case are substantially prevented from affecting the electronic device.

BACKGROUND OF THE INVENTION

Carrying cases are common for securing and protecting sensitive and expensive electronic devices. As used herein, electronic devices as described include PDAs, MP3 players, cellphones, cameras, radios, calculators, CD players, and any other similar device that may employ a display screen or other sensitive componentry. It is desirable to maintain the integrity of display screens of the electronic devices by ensuring that they do not become scratched or otherwise damaged inside the case.

Carrying cases in the art sometimes include a tab, generally a strap, that is hingedly interconnected to a portion of the case. More specifically, some cases in the art employ a tab that is rotatably interconnected to an upper portion of the case and is selectively interconnectable to a bottom portion of the case, thereby providing a loop for engagement to an individual's belt, for example. Some embodiments of the prior art employ a snap that selectively interconnects the free end of the tab to the case. Unfortunately, when the snap is employed, potentially damaging pressure loads may be transferred through the compliant case and ultimately to the electronic device.

Thus, it is a long felt need in the field of electronic device carrying cases to provide a carrying case that protects the stored item and substantially prevents outside point loads from interacting with the electrical components stored therein. The following disclosure describes an improved carrying case that includes a resiliently deflectable panel for engagement with a user's finger to thereby provide a reaction load to counteract the loads emanating from the utilization of the snaps commonly found on storage cases in the art.

SUMMARY OF THE INVENTION

It is thus one aspect of the present invention to provide a carrying case for securing an electronic device. More specifically, one embodiment of the present invention is a carrying case comprising a front panel that is selectively interconnected to a back panel via a zipper or other closure mechanism. The carrying case may also includes a tab hingedly interconnected to an upper edge of the back panel of the storage case that is adapted to transition outwardly and loop around an individual's belt. Alternatively, the storage case may be secured to another carrying case. In addition, a selective interconnection device is employed on an opposite end of the tab for interconnection to a mating interconnection device adjacent to the lower edge of the storage case.

It is another aspect of the present invention to provide a resilient panel connected to the back panel of the carrying case that provides a location for the interconnection of the selective interconnection device. The advantage of this configuration is that force emanating from engaging the selective interconnection device is substantially prevented from transferring through the generally compliant sidewalls of the carrying case. Thus, loads that may damage delicate display screens are significantly reduced. More specifically, in operation, an individual slides their finger between the resilient panel and the back panel of the carrying case and uses their thumb to snap the other portion of the selectively interconnecting device onto the resilient panel. Once the user's finger is removed, the resilient panel will return to its normal position. One skilled in the art will appreciate that many types of selectively interconnecting devices may be employed without departing from the scope of the invention, including hook and loop fasteners.

It is yet another aspect of the present invention to provide an auxiliary pocket integrated into the front or back panel of the storage case. Specifically, the auxiliary pocket is adapted to secure small items, such as batteries and film. Preferably, one embodiment of the present invention also employs a transitioning member, generally a rectangular panel with a mesh pocket integrated thereon, for insertion into the auxiliary pocket. In addition, a pull tab may be provided adjacent to an upper edge of the transitioning member and an elastic element may be employed on a lower edge of the transitioning member that is interconnected to the lowermost portion of the inside of the auxiliary pocket. Thus, when an individual pulls on the transitioning member, it is moved out of the pocket to expose the mesh pocket. Once the user releases the pull tab, the transition member quickly springs back into place and is hidden, at least partially, in the auxiliary pocket.

It is another aspect of the present invention to provide a pass-through aperture to accommodate the wrist strap generally found on most cameras. More specifically, a small aperture or slit may be provided in the storage case that allows for the wrist strap to be threaded therethrough to provide the means for an individual to use the wrist wrap while protecting the electronic device inside the storage case.

It is another aspect of the present invention to provide a storage case that is constructed of commonly used materials that provide cushioning and protection from the elements. More specifically, various embodiments of the present invention may be fabricated of nylon, rubber, leather, koskin, foam, and other commonly used materials that are stitched together using known techniques. The resilient panel of one embodiment of the present invention is constructed of an elastic material that returns to its nominal shape after use. In addition, the materials in construction of the carrying case are apt to be highly durable and easy to clean.

Thus, in one aspect of the present invention, a carrying case is provided which generally comprises:

a front panel;

a back panel selectively interconnected to said front panel;

a tab rotatably interconnected to an upper edge of said back panel, said tab having a first portion of a selective interconnection device positioned on a free end thereof;

a resilient panel with a second portion of a selective interconnection device interconnected to a lower edge of the back panel; and wherein said resilient panel is capable of being deflected from said back panel thereby generally preventing said second portion of a selectively interconnecting device from transmitting forces to said back panel when said first portion of a selective interconnection device is interconnected thereto.

The Summary of the Invention is neither intended nor should it be construed as being representative of the full extent and scope of the present invention. The present invention is set forth in various levels of detail in the Summary of the Invention as well as in the attached drawings and the Detailed Description of the Invention and no limitation as to the scope of the present invention is intended by either the inclusion or non-inclusion of elements, components, etc. in this Summary of the Invention. Additional aspects of the present invention will become more readily apparent from the Detail Description, particularly when taken together with the drawings.

BRIEF DESCRIPTION OF THE DRAWINGS

The accompanying drawings, which are incorporated in and constitute a part of the specification, illustrate embodiments of the invention and together with the general description of the invention given above and the detailed description of the drawings given below, serve to explain the principles of these inventions.

Figure 1:
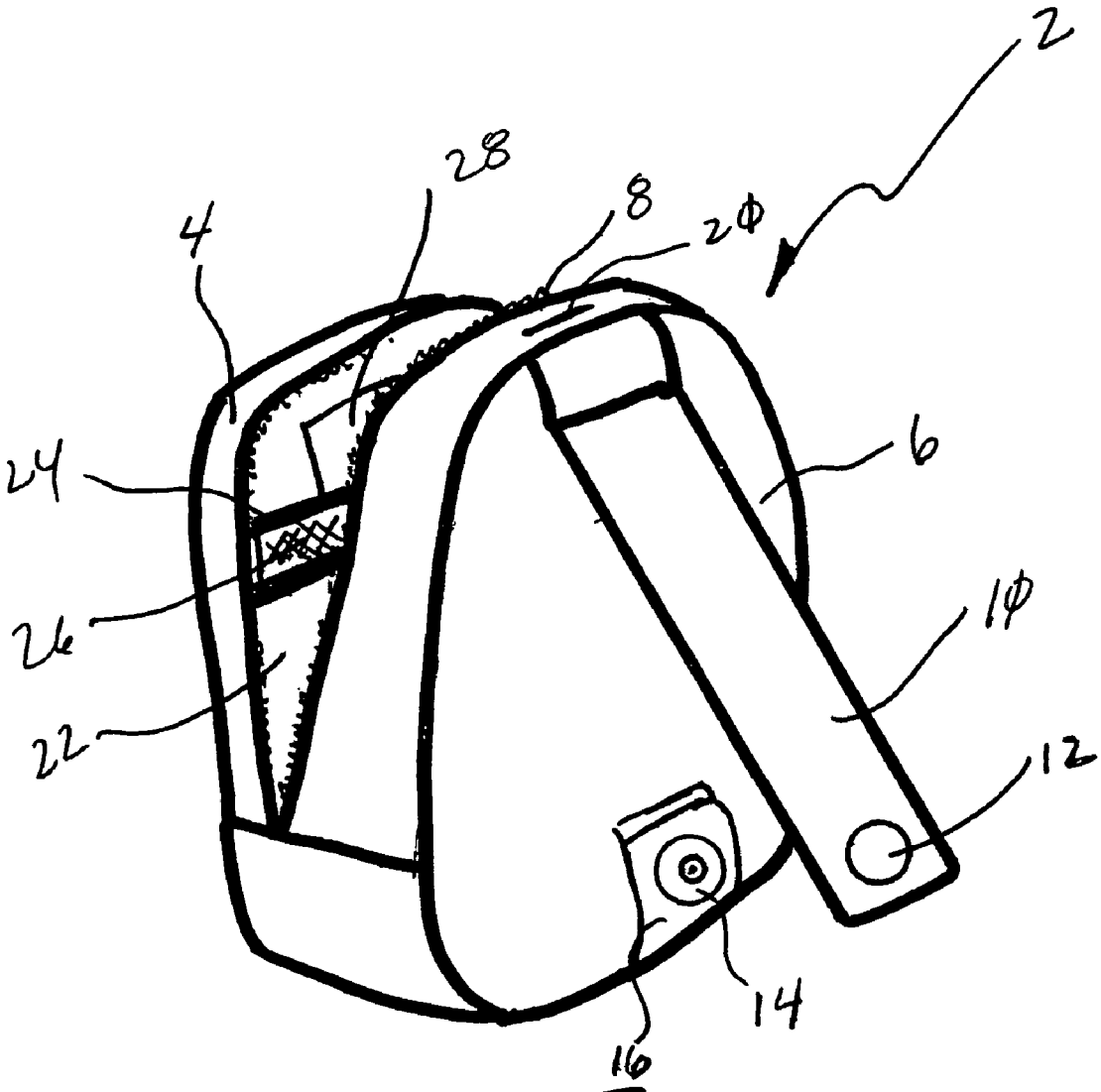
FIG. 1 is a rear perspective view of the carrying case of one embodiment of the present invention.

To assist in the understanding of the present invention the following list of components and associated numbering found in the drawings is provided herein:

| # | Component |
|---|---|
| 2 | Carrying case |
| 4. | Front panel |
| 6 | Back panel |
| 8 | Zipper |
| 10 | Tab |
| 12 | Female snap |
| 14 | Male snap |
| 16 | Resilient panel |
| 18 | Finger |
| 20 | Pass through aperture |
| 22 | Pocket |
| 24 | Transitioning member |
| 26 | Mesh panel |
| 28 | Pull tab |
| 30 | Opening |

It should be understood that the drawings are not necessarily to scale. In certain instances, details that are not necessary for an understanding of the invention or that render other details difficult to perceive may have been omitted. It should be understood, of course, that the invention is not necessarily limited to the particular embodiments illustrated herein.

DETAILED DESCRIPTION

Referring now to FIGS. 1-4, a carrying case 2 depicting one embodiment of the present invention that utilizes a mechanism for protecting the components stored within the case from external loads, such as from a user's finger, is shown. More specifically, a case 2 commonly used to store electronic devices, such as PDAs, cellphones, MP3 players, video games, cameras, etc. is shown that includes a front panel 4 selectively interconnected to a back panel 6. The panels are adapted to selectively secure to each other with a securing mechanism, preferably a zipper 8, hook & loop material, etc. The case 2 also includes a tab 10, a generally elongated strip of material, for insertion about a user's belt or for use as a carrying handle. The tab 10 of one embodiment of the present invention also includes a selectively interconnecting device 12, such as a snap, which is adapted to interconnect to a mating interconnecting device 14 that is operably interconnected to the back panel 6 of the carrying case 2. In order to prevent loads emanating from the operation of interconnecting the selectively interconnectable devices together, a resilient panel 16 is included that is interconnected to the back panel 6. In operation, the user slides his or her finger 18 between the resilient panel 16 and the back panel 6, thus isolating the interconnection device 14 away from the storage case 2, wherein the adjoining interconnection device 12 located on the tab 10 may be interconnected thereto without substantially transferring loads into the case 2 that may damage the delicate electrical component stored therein.

Figure 2:
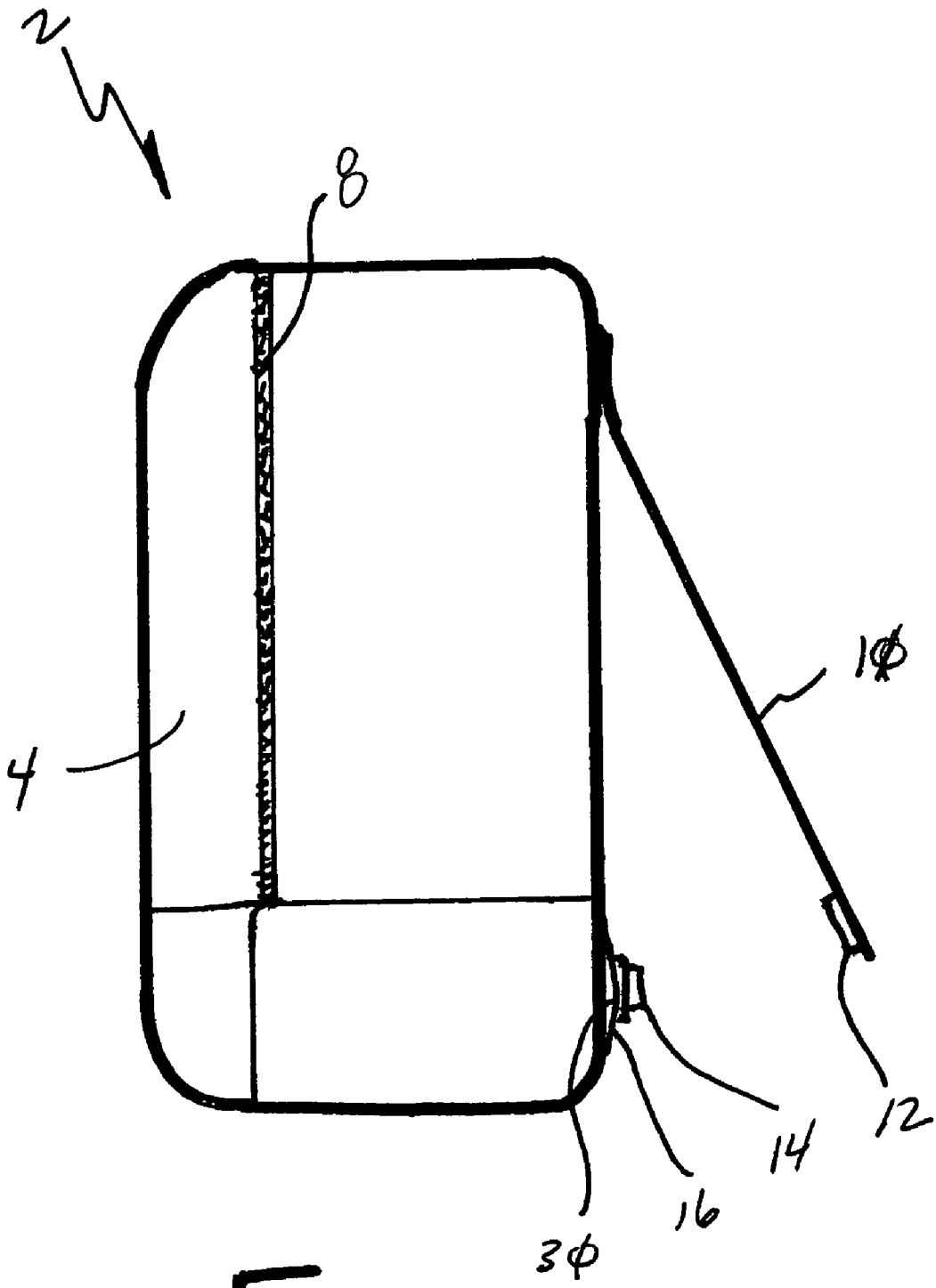
FIG. 2 is a right elevation view of the carrying case shown in FIG. 1.
Figure 3:
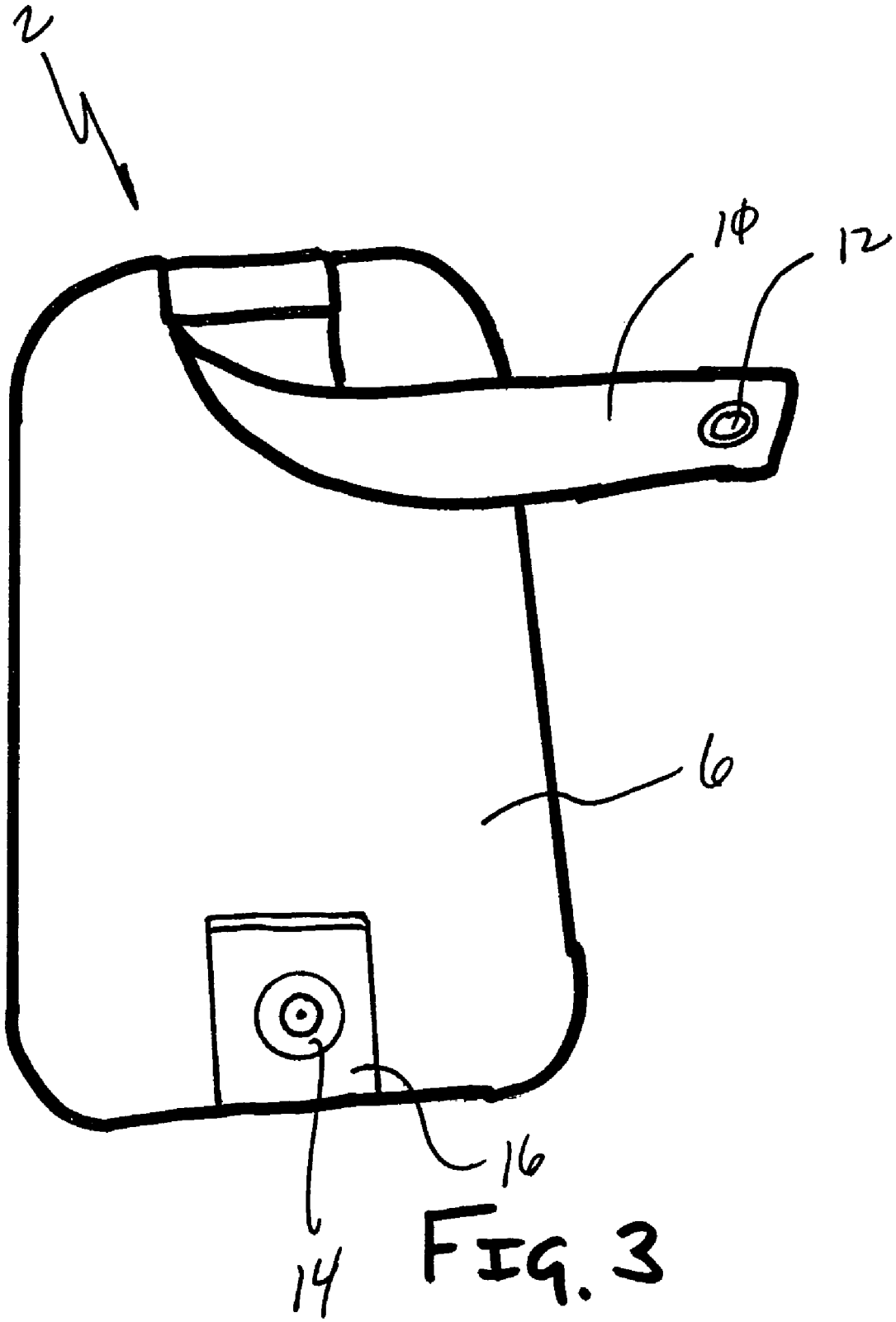
FIG. 3 is a rear elevation view of the carrying case shown in FIG. 1.

Referring now to FIGS. 1-3, one embodiment of a carrying case 2 equipped with the resilient panel 16 is shown. Here, a generally rectangular storage case that includes a commonly used zipper 8 to interconnect the front panel 4 to the back panel 6 is shown. In addition, a tab 10 is provided which is rotatably interconnected to a top edge of the front panel 4. Alternatively the tab 10 may be interconnected along a lower edge or lateral edges of the carrying case 2. The tab 10 also includes a female snap 12 interconnected to a free end thereof. The tab is able to rotate outwardly and engage an item, such as a belt, and be selectively interconnected to an area adjacent to a lower edge of the back panel 6 of the carrying case 2.

Preferably, one embodiment of the present invention includes a resilient panel 16 interconnected adjacent to the lower edge of the back panel 6. The resilient panel 16 provides a location for the interconnection of a male snap 14 that selectively interconnects to the previously described female snap 12. Once the tab 10 is snapped in place, a loop is provided that is adapted to receive a belt, strap, harness, or other carrying case. As shown herein, commonly used snaps are employed, however, one skilled in the art will appreciate that other selectively interconnecting mechanisms 14 may be employed without departing from the scope of the invention such as hook and loop fasteners, latches, magnets, etc.

With specific reference to FIG. 1, a pass-through aperture 20 may also be integrated into the carrying case 2. More specifically, a small aperture or slit may be provided in an upper surface of the carrying case 2 wherein a wrist strap commonly employed by electronic devices such as cameras, may be threaded therethrough. Thus, the user may utilize the wrist strap while the electronic device is protected.

One skilled in the art will appreciate the carrying case 2 of this nature may include auxiliary pockets 22 for the storage of other items, such as film. In addition, a transitioning member 24 may also be employed that is integrated into the pocket 22. More specifically, one embodiment of the present invention includes a transitioning member 24 that is generally a rectangular rigid or semi-rigid member that includes a mesh pocket 26. In addition, a pull tab 28 may be affixed to an upper edge of the transitioning member 24. The transitioning member 24 thus provides a location for the storage of small flat items, such as keys, for example. In one embodiment of the present invention it is contemplated that the pull tab 28 be used to selectively slide the transitioning member 24 out of the pocket provided in the front panel 4 of the carrying case 2. In addition, an elastic element (not shown) may be interconnected to a bottom edge of the transitioning member and adjacent to the lowest most portion of the inside of the pocket 22. The user exposes the mesh pocket 26 by pulling on the pull tab 28 wherein release of pull tab 28 will necessarily cause the transitioning member 24 to quickly return to the pocket 22.

Figure 4:
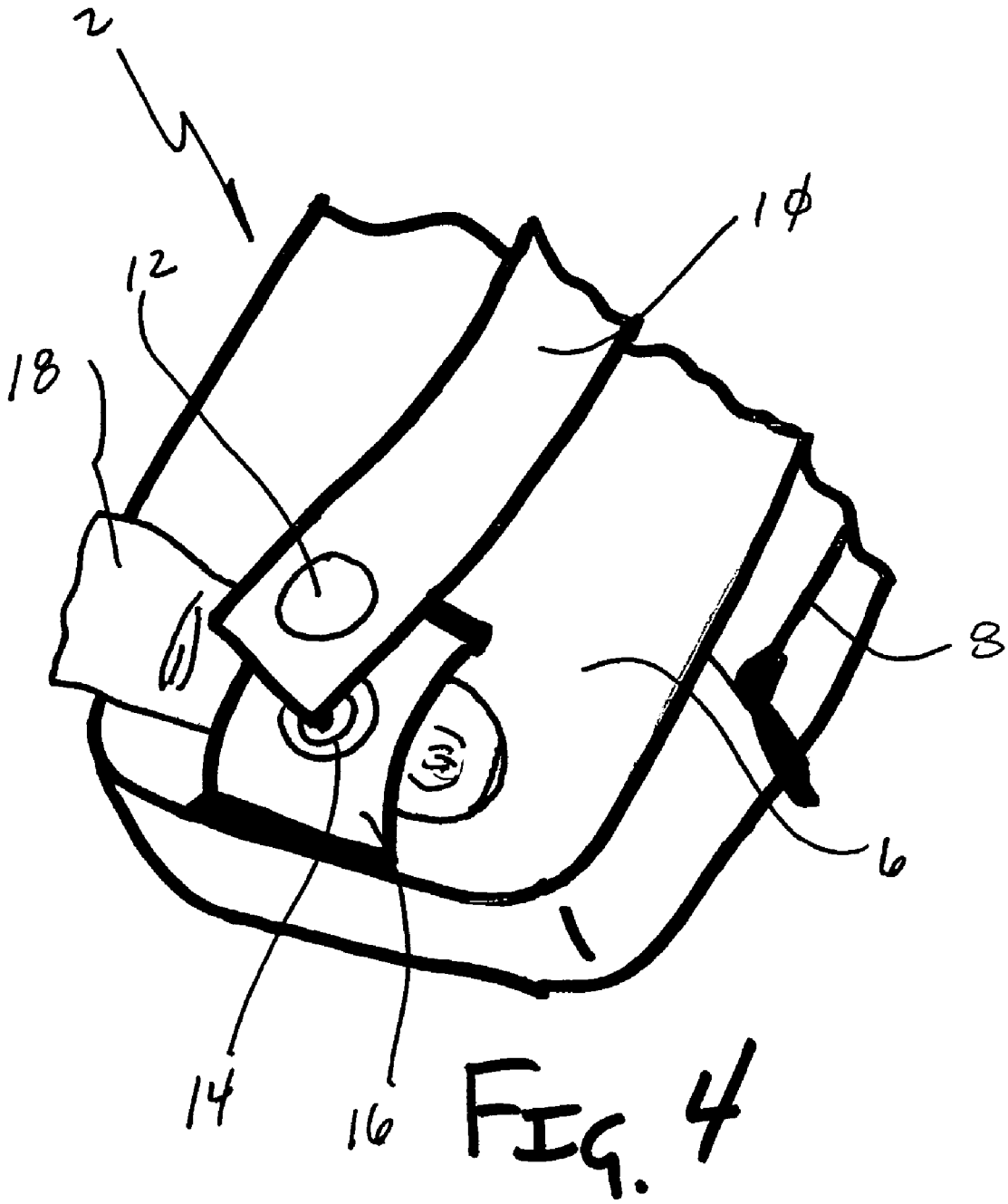
FIG. 4 is a partial rear perspective view of the carrying case shown in FIG. 1 also showing an individual's finger deflecting a resilient panel.

Referring now to FIG. 4, one method of implementing the present invention is shown. In operation, to ensure that excessive forces are not transferred to the stored electronic device, the resilient panel 16 is transitioned outwardly from the back panel 6 to provide an opening 30 for the insertion of the individual's index finger 18. The female snap 12 is then interconnected to the male snap 14 by applying pressure with one's thumb to firmly fasten the snap ends together. Thus, generally all loads associated with the force required to interconnect the snaps are applied to the individual's finger 18 instead of being transferred inside the carrying case 2. More specifically, since storage cases of the art are generally made of a compliant material, forces emanating from the outside of the case are often transferred into the case since the material itself does not supply sufficient reaction forces.

Alternatively, one skilled in the art will appreciate that a related embodiment of the present invention may include a rigid backing plate integrated onto the back panel 6 of the carrying case 2. More specifically, one half of the snap may be positioned on the backing plate such that loads generated by interconnecting the snap portion located on the tab to the snap portion located on the backing plate are substantially prevented from affecting the stored item.

Referring now to FIGS. 1-4, a manner of making the invention is described. Carrying cases as described herein are generally well known in the art, and are often constructed of compliant materials, such as leather, nylon, polyethylene, extruded foam, rubber, or any other materials known that are adapted to provide cushioning and protection from the elements. In addition, selective interconnection devices between the tab 10 and the resilient panel 16 are well known in the art, such as shown herein, which include a snap closure. Further, the resilient panel 16 of one embodiment of the present invention is constructed of an elastic material that returns to its nominal state after use. Methods manufactured of the device contemplated by the present invention include generally well known techniques such as sewing.

While various embodiments of the present invention have been described in detail, it is apparent that modifications and alterations of those embodiments will occur to those skilled in the art. However, it is to be expressly understood that such modifications and alterations are within the scope and spirit of the present invention, as set forth in the following claims.

What is claimed is:

1. A carrying case for protecting the screen of an electronic device, comprising:

a front panel;

a back panel selectively interconnected to said front panel to define a storage volume;

a tab rotatably interconnected to a first location of said back panel, said tab having a first portion of a selective interconnection device positioned on a free end thereof;

a resilient stretchable panel having a first end and a second end interconnected to said back panel;

a second portion of a selective interconnection device interconnected to said resilient stretchable panel; and wherein said resilient stretchable panel is capable of being pulled away from said back panel thereby preventing said second portion of a selectively interconnecting device from transmitting forces to said back panel when said first portion of a selective interconnection device is interconnected thereto.

2. The carrying case of claim 1, wherein said first portion of a selective interconnection device is a female snap and said second portion of a selective interconnection device is a male snap.

3. The carrying case of claim 1, further including an auxiliary pocket integrated into an inner surface of said front panel.

4. The carrying case of claim 3, further including a transitioning member with a pocket thereon positioned in said auxiliary pocket.

5. The carrying case of claim 1, further including an aperture that is adapted to receive a wrist strap.

6. The carrying case of claim 1, wherein said front panel and back panel are adapted to enclose a camera.

7. A carrying case for protecting the screen of an electronic device, comprising:

a front panel;

a back panel selectively interconnected to said front panel to form a carrying case for receiving an electronic device;

a belt having a first end and a second end, said first end interconnected to said back panel;

a first portion of a selective interconnection means interconnected to said second end of said belt;

a stretchable panel having a first end and a second end each interconnected to said back panel, and adapted to be pulled away from said back panel with a user's fingers; and a second portion of said selective interconnection means interconnected to said stretchable panel;

wherein said stretchable panel is capable of being deflected from said back panel to allow said first and said second interconnection means to be joined without applying any forces to said back panel.

8. The carrying case of claim 7, wherein said first portion of a selective interconnection means is a female snap and said second portion of a selective interconnection means is a male snap.

9. The carrying case of claim 7, further including an auxiliary pocket integrated into an inner surface of said front panel.

10. The carrying case of claim 9, further including a transitioning means with a pocket thereon positioned in said auxiliary pocket.

11. The carrying case of claim 7, wherein said stretchable panel is an elastic material.

12. The carrying case of claim 7, further including an aperture that is adapted to receive a wrist strap.

13. The carrying case of claim 7, wherein said front panel and back panel are adapted to enclose a digital camera.

14. A carrying case adapted for storing an electronic device, comprising:

a front panel;

a back panel selectively interconnected to said front panel to define a storage volume;

a tab having a first end and a second end, said first end interconnected to said back panel, and said second end including a first interconnection means;

a stretchable panel having a first end and a second end interconnected to said back panel of said carrying case and adapted to be pulled away from said back panel with a user's fingers;

a second interconnection means interconnected to said stretchable material between said first end and said second end and which is adapted for selective interconnection with said first interconnection means.

15. The carrying case of claim 14, wherein said stretchable material is capable of at least two positions of use, one being adjacent to the back panel and another being positioned slightly away from said back panel thereby providing a location for a user's finger.

* * * * *